United States Patent [19]

Wagner

[11] Patent Number: 4,911,561

[45] Date of Patent: Mar. 27, 1990

[54] SHOPPING BAGS OF THERMOPLASTIC SYNTHETIC RESIN SHEETING WITH LATERAL WELD SEAMS, AND PROCESS FOR THE PRODUCTION THEREOF

[75] Inventor: Robert Wagner, Troisdorf-Sieglar, Fed. Rep. of Germany

[73] Assignee: Stiegler GmbH Maschinenfabrik, Rudersberg, Fed. Rep. of Germany

[21] Appl. No.: 228,593

[22] Filed: Aug. 5, 1988

[30] Foreign Application Priority Data

Aug. 5, 1987 [DE] Fed. Rep. of Germany ..... 3725901

[51] Int. Cl.[4] ..... B65P 33/08

[52] U.S. Cl. ..... 383/10; 383/13; 383/27; 206/554

[58] Field of Search ..... 383/10, 7, 6, 9, 13, 383/17, 22, 26, 27, 78, 84, 86.2, 37; 206/554

[56] References Cited

U.S. PATENT DOCUMENTS 4,528,694 7/1985 Skougaard ..... 383/10
4,555,025 11/1985 Weinberg et al. ..... 383/10
4,690,280 9/1987 Meyer ..... 206/554

FOREIGN PATENT DOCUMENTS 1958248 11/1971 Fed. Rep. of Germany ..... 383/27

*Primary Examiner*—Willis Little
*Attorney, Agent, or Firm*—Antonelli, Terry & Wands

[57] ABSTRACT

A shopping bag of thermoplastic synthetic resin sheeting with lateral weld seams wherein, at the bag opening, the front wall is fashioned with a straight rim, and the rear wall is fashioned to project beyond the front wall with an approximately sinusoidal rim to form a protruding flap. The sinusoidal rim of the rear wall terminates either above or below the rim of the front wall in the lateral weld seams. A process for the production of the shopping bags by sinusoidal cutting apart of a film ply of a tubular sheet involves a series of sequential operation at successive stages or stations.

23 Claims, 5 Drawing Sheets

SHOPPING BAGS OF THERMOPLASTIC SYNTHETIC RESIN SHEETING WITH LATERAL WELD SEAMS, AND PROCESS FOR THE PRODUCTION THEREOF

This invention relates to a bag especially a shopping bag of thermoplastic synthetic resin sheeting with a front wall, a rear wall, selectively formed handle holes in the zone of the bag opening, and lateral weld seams, optionally with a handle leaf to reinforce a handle hole and/or a bottom pleat, as well as to a process for the production of this bag.

Shopping bags having a sinusoidal load-bearing rim are known, for example, from German Patent No. 2,754,078. Shopping bags having a sinusoidal load-bearing rim and an interlocking section projecting past the bag opening, which section can be torn off by way of a perforation, have been known, for example, from German Patent No. 3,424,748, DOS 3,543,727 and DOS 2,336,906 or DOS 3,613,297.

The invention is based on the object of providing an inexpensive and economically producible shopping bag of thermoplastic synthetic resin sheeting of the type discussed above, e.g., a bag made of a polyolefin such as polyethylene, which bag is to be readily fillable. Moreover, the shopping bag is also to lend itself to be interlocked into tear-off packs. Furthermore, one objective of the invention resides in creating a bag, the opening of which can be optionally sealed at least partially by a foldable flap.

This object has been attained according to this invention by a shopping bag of the type described above wherein, at the bag opening, the front wall is fashioned with a straight rim and the rear wall is fashioned to project beyond the front wall with an approximately sinusoidal rim whereby a protruding flap is formed and the sinusoidal rim of the rear wall terminates either above or below the straight rim of the front wall in the lateral seams.

The invention provides a shopping bag having a unilaterally protruding sinusoidal rim at the bag opening which rim can be utilized for interlocking and for folding. The shopping bag can be further developed in various ways. In the simple design of the shopping bag, the rear wall projects with the flap also at the lateral seams beyond the front wall. The bag can be readily filled by sizing the front wall. If it is desired to seal the bag, then the flap of the rear wall can be folded over toward the front. An improved sealing possibility for the bag is offered, however, by a bag wherein, according to the invention a marginal strip is folded inwardly from the front wall at the bag opening over the entire bag width and is welded in place along the lateral weld seams, the sinusoidal rim of the rear wall terminating below the folded marginal strip in the lateral weld seams. At the folding edge of the marginal strip, a slot is fashioned with a length adequate for passing the flap of the rear wall therethrough. The shopping bags ca be designed with or without a bottom pleat; the bags can exhibit corner weld seams in the individual bottom pleat portions, starting from the lateral seals whereby a flat bottom is formed. The handle holes of the bags can be equipped with a handle leaf reinforcement which is preferably welded on the inside. For producing tear-off blocks, the flap projecting at the rear wall with respect to the front wall of the bag is preferably provided with a row of perforations extending in parallel to the linear rim, there being formed at least one hanging-up hole in the flap portion that can be torn off, and the flap being interlocked into a tear-off block with additional bags. In the projecting flap, a handle hole can be additionally arranged which, when the flap is folded over the bag opening, comes into congruent relationship with the handle holes of the walls.

For reasons of manufacturing technique, the flap is provided, in one version of the bag, with two rows of perforations extending in parallel to the opening rim of the front wall, at least one hanging hole being formed between these rows, the interlocking likewise taking place within this zone. In this arrangement, the row of perforations lying on the outside is without functional significance.

In case a unitary load-bearing rim of the bag is desired at the front and rear walls, this can be done in case of bags having a folded-in marginal strip by die punching of the front wall in the region of the portions laterally protruding past the flap. Punching takes place with a sinusoidal cutting line with simultaneous cutoff welding whereby the cutting edge is sealed.

The bag according to this invention can be manufactured economically either from a tubular film or a flat sheetingwherein also in case of the interlocked bags there is merely a minimum of waste. The interlocking section can be kept very small. The bag is produced in pairs. With the use of a tubular sheet, the latter is cut open on one side centrally with a linear cut and a gap is formed by pulling the film edges apart; whereas a flat sheeting is folded to form a tubular sheet with a central gap remaining between the sheet edges. The gap is in all cases to be maintained wider than the amplitude height of a sinusoidal separating cut to be produced subsequently on the lower film ply lying in opposition to the gap, this cut being performed so that it extends in the longitudinal direction of the sheeting. The separated sheets are then further conveyed while being offset with respect to each other by half a wavelength. In the following process steps, the varying bag shape is then defined; in this connection, the film rims can be folded over, bottom pleats are formed, handle holes ar punched in, optionally hanging holes an additional handle holes are punched into the flap, corner weld seams are welded in the bottom pleats, and the bags are severed by cutoff welding transversely to the longitudinal extension, in each case in the wave troughs.

The row of ear-off perforations for the flap from the rear wall of the bag is formed within the amplitude of the sinusoidal severing cut on the bottom film ply, and can be made in the manufacturing process either continuously already prior to execution of the sinusoidal severing cut, or advantageously also after the manufacture and stacking of the bags in a stack. A row of perforations can be produced in the longitudinal axis of the sinusoidal separating cut in the bottom film ply. It is also possible to provide two rows of perforations in parallel to and on both sides of the longitudinal axis within the amplitude of the sinusoidal separating cut. This is advantageous in case of shallow amplitudes in order to obtain a maximally wide interlocking section.

Heat-sealable thermoplastic synthetic resin films for example on polyolefin basis can be utilized for the shipping bags. In order to obtain adequate stiffness of the bag during opening even with small wall thicknesses of the film of 10–30 μm, it is suggested to utilize unilaterally or bilaterally embossed synthetic resin films. Preferably, a unilaterally embossed synthetic resin film is utilized wherein the embossed film side constitutes the inside of the bag. The smooth outside is in this case robust and readily imprintable; whereas the bag can be easily opened since the profiled surfaces do not adhere so tenaciously to each other. It is also possible to use composite sheeting from identical or differing materials; these can be bonded together by means of embossing.

In order to increase the strength of the lateral seams of the bags, these can be produced, according to a further proposal of the invention, by double welding. In this procedure, first a flat contact weld seam is produced over which teen a second weld seam is executed with simultaneous cutting.

In order to obtain bags having a large opening sinusoidal cut of large amplitude is necessary. The larger the amplitude, the slower the cutting speed, however, and thus the slower the production rate in the continuous bag manufacturing process. The shallower the amplitude, the faster the cutting and manufacturing operations. Therefore, a further development of the invention proposes, for obtaining large amplitudes in the zone of the wave troughs of the sinusoidal rim, i.e. the cut-open film, that subsequently approximately triangular cutouts are punched out. These triangular cutouts are formed maximally tangentially in an extension of the wave crests.

Additionally details of the invention are illustrated in the accompanying drawings providing schematic representations wherein.

Figure 3:
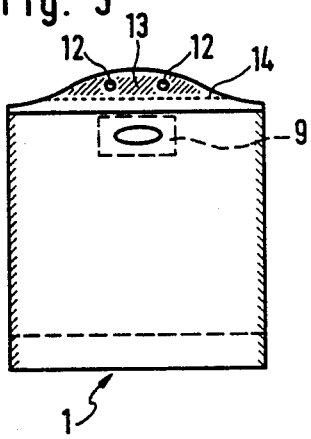
Figure 14A:
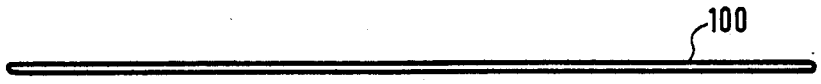
Figure 14B:
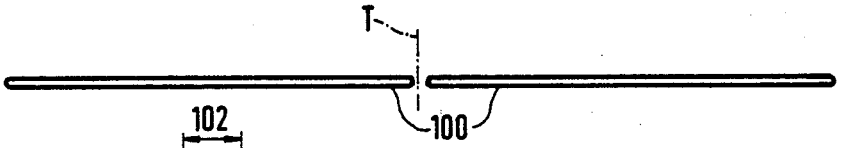
Figure 14C:
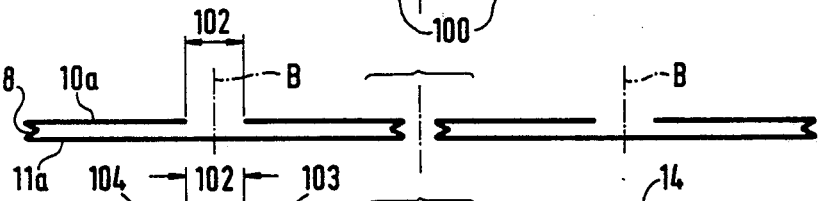
Figure 14D:
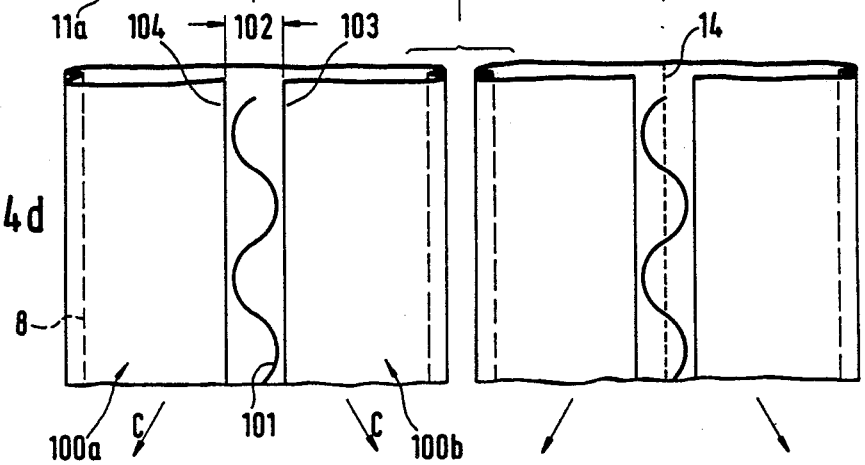
Figure 15:
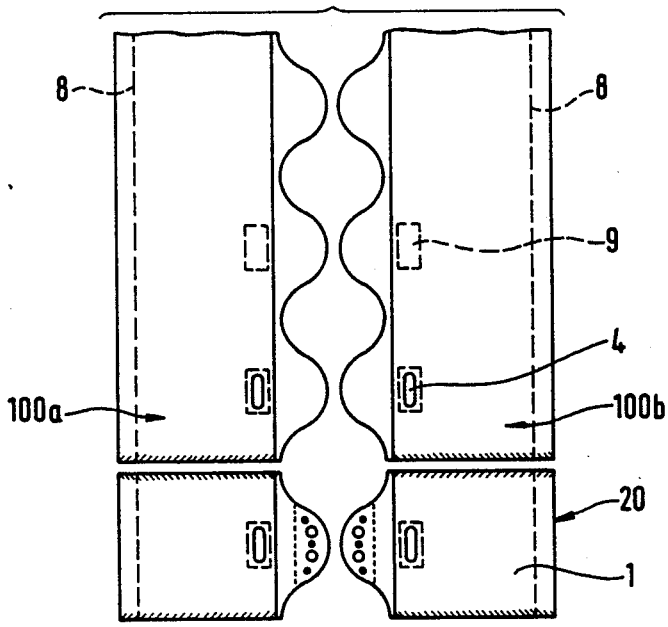
Figure 16:
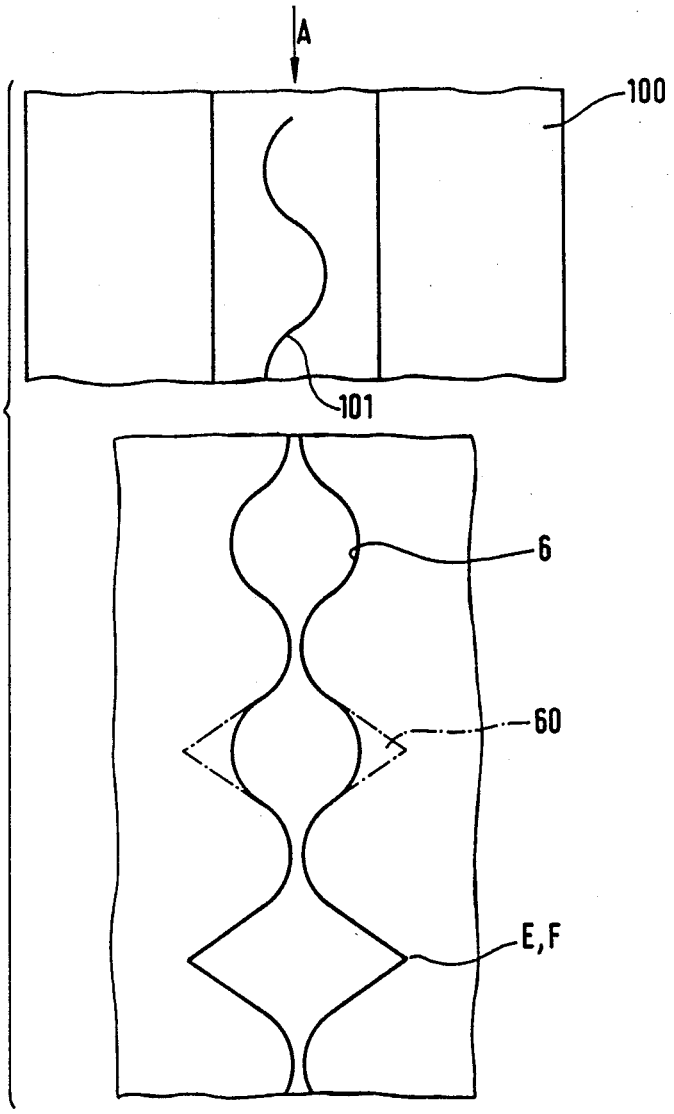

FIGS 14*a–d* and 15 show a schematic flow chart of the pairwise manufacture of shopping bags from a tubular sheet according to FIG. 3; and FIG. 16 is a schematic representation showing manufacture of shopping bags having a large sinus amplitude.

Figure 1:
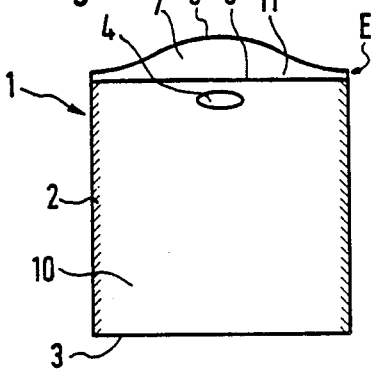
FIGS. 1–5, 17 and 18 illustrate various shopping bags in an elevational view with a unilaterally projecting sinusoidal flap.
Figure 18:
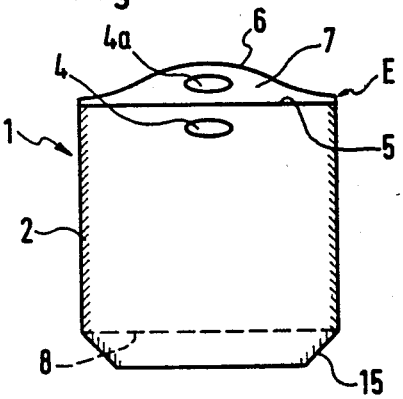

FIG. 1 shows the basic configuration of a shopping bag 1 with a front wall 10 and a rear wall 11, a bottom pleat edge 3 and lateral weld seams 2, handle holes 4. The front wall terminates in the zone of the bag opening with the straight rim 5; the rear wall 11 is fashioned with the sinusoidal rim 6 and projects with the entire wave crest as flap 7 beyond the rim 5 of the front wall 10. Laterally, the wave crest terminates above the linear rim 5 at the corner E. The protruding sinusoidal flap 7 can here be utilized in various ways, for example as an interlocking section or as a hanger and a sealing flap. The basic form of the shopping bag according to FIG. 1 can be varied in a great many ways. The shopping bag can be designed with a bottom pleat 8 according to FIG. 2 or with a flat bottom according to FIG. 18 by means of additional corner weld seams 15 in the bottom pleat portions. A handle hole 4*a* can be provided in the flap 7, serving for hanging up the bags, and after sealing of the bag opening, resting in a congruent fashion on the other handle holes 4 in the front and rear walls by folding over. The bag 1 can be provided, according to FIG. 3, in the zone of the handles holes 4 with a handle leaf reinforcement 9 of thermoplastic synthetic resin film which is applied on the outside or inside in an adhesive fashion, for example by gluing, preferably by welding. The projecting flap 7 can exhibit a row of tear-off perforations 14 extending closely along the rim 5 of the front side. Hanging holes 12 are provided above the row of perforations 14 in the flap 7. The interlocking feature can be located therebetween. Interlocking with further bags, i.e. flaps 7, can be designed as spot-like interlocking or as a flat interlocking area 13. Optionally, a second row of perforations 14*a* is present in the upper zone of the flap 7, see FIG. 4, for example, but this last-mentioned row does not perform an further function.

Figure 4:
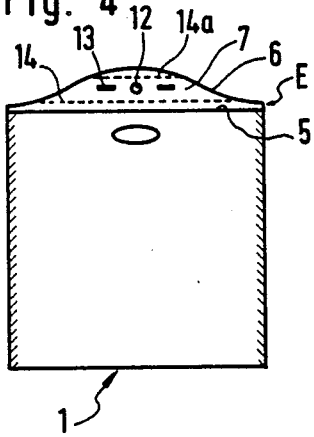
Figure 12:
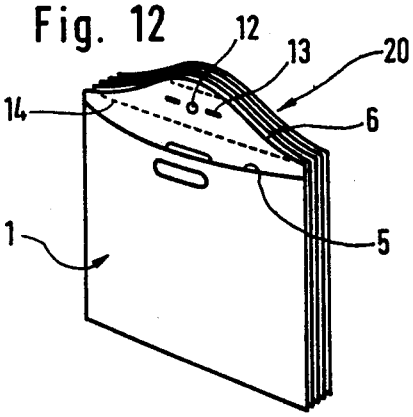
FIG. 12 is a schematic view of a tear-off block with shopping bags according to FIG. 4.

FIG. 4 shows a single shopping bag 1 with only one hanging hole 12, a row of perforations 14 and interlocking 13 in the zone of the flap 7. The associated tear-off block 20 made up of a plurality of bags is illustrated in FIG. 12. The bags 1 can be readily seized at the rim 5, opened, filled while hanging at the block and torn off.

Figure 5:
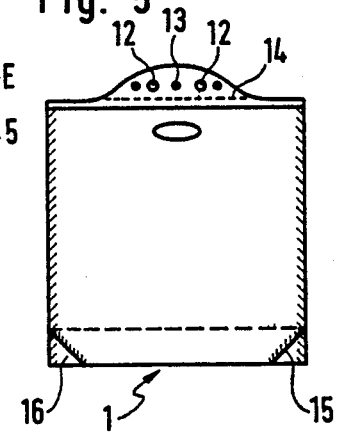

FIG. 5 shows a shopping bag with a flat bottom, fashioned by the bottom pleat 8, the bottom pleat portions of which are cut away by welding in the corners 15. The corner sections 16 can be removed by punching.

Figure 17:
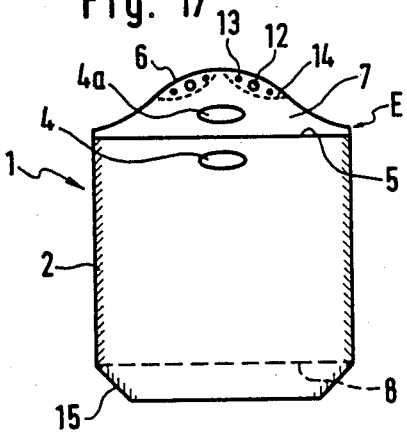

FIG. 17 shows a shopping bag 1 with flat bottom and having perforations 14 for two interlocking sections above a handle hole 4*a* punched out in the flap 7.

In all of the aforementioned bags, the sinusoidal rim 66 must in all cases terminate above the opening edge 5 of the front bag wall, see corner E, since if the sinusoidal cut were to extend into the zone of the front wall of the bag, the pieces of film cut away during this step would fly around uncontrollably as waste. Thus, in order to obtain a clean sinus separating cut during manufacture of the bags, this bag design proves to be advantageous.

FIGS. 6 through 11 illustrate bags equipped with a sealing means at the bag opening.

In these bags 1, the marginal strip 17 is folded over inwardly at the front wall at the bag opening over the entire bag width and is welded laterally into the lateral weld seams 2. The rear wall 11 has the sinusoidal rim 6 with said portions that terminate laterally below the zone of the folded-over marginal strip 17, see corners F, and projects with the sinusoidal flap 7 beyond the folded-over edge 11 of the marginal strip of the front wall 10, see FIGS. 7 and 8. A handle hole 4 is punched into the bag in the zone of the folded marginal strip 17; a slot 18 is punched along the folding edge 111 of the marginal strip in a width somewhat larger than the width of the adjoining flap 7. After filling the bag, the flap 7 is passed, for closing the bag opening, through the slot 18 from below, see FIG. 8. In these shopping bags according to FIGS. 6–11, the sinusoidal opening rim 6 must always terminate below the folded-over marginal strip 17 into the lateral weld seams since otherwise the sinus flap cannot be passed perfectly below the marginal strip and through the slot. Otherwise, the flap would hang up at the corner of the marginal strip edge and the lateral seam.

Figure 9:
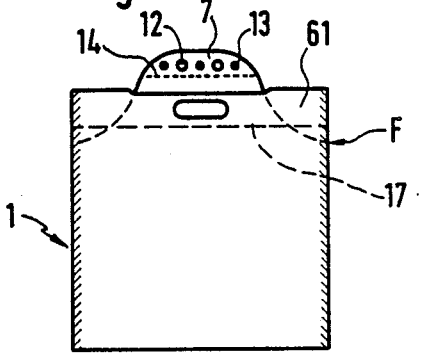
FIGS. 9 through 11 show variations of the shopping bag according to FIG. 6.
Figure 10:
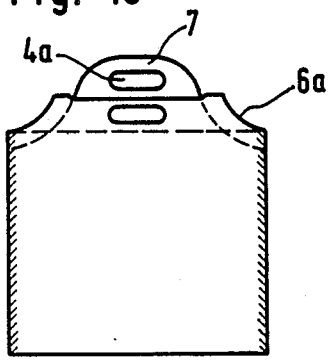
Figure 11:
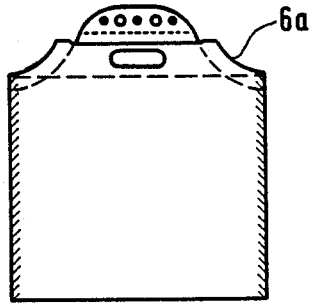

FIG. 9 shows a bag with seal, which is designed as a bag that can be interlocked, with a tear-off block, the projecting flap 7 being provided with a row of perforations 14, hanging holes 12, and interlocking means 13. The laterally protruding sections 61 can be punched away, for example, with an approximately sinusoidal severing cut 6a, see FIG. 10, and can be welded together simultaneously. The bag then obtains a more pleasing appearance, see also FIG. 11. Also, in the case of this bag, the projecting flap can be equipped with an additional handle hole 4a, see FIG. 10. After passing the flap 7 through the pass-through slot 18, this flap portion can then be likewise folded downwardly and utilized for load-carrying purposes.

Depending on the size of the bags to be manufactured, production of the bags can be performed in pairs or also in quartets, starting with a tubular sheet 100, see FIG. 14a. The tubular sheet 100 is subdivided into two tubular sheets by a central cutoff weld T, see FIG. 14b. Then, according to FIG. 14c, the top film ply is cut open along a center line B by a linear severing cut. The cut-open top film plies 10a are pulled apart toward both sides to such an extent that the gap 102 is formed between the film edges. Along the lateral edges, bottom pleats 8 can be inserted at this point in time or later on. FIG. 14d shows, in a top view, the further finishing operation performed on the unilaterally severed tubular sheet. Within the gap 102, the bottom film ply is cut open with the sinusoidal severing cut 101. The gap 102 is in all cases somewhat broader than the amplitude of the severing cut 101 to ensure perfect cutting and guidance of the tool. It is also possible to cut out a strip in the desired gap width, instead of performing the straight opening cut. Before beginning the sinusoidal cutting operation, the bottom film ply can be perforated within the amplitude of the sinus cut in parallel to the longitudinal axis B, i.e. in one or two rows of perforations 14, see FIG. 14d. Thereafter, the thus-produced semitubular sheets 100a, *b* are made to diverge in the direction of arrow C an thus are mutually offset by half a wavelength so that wave crests and wave troughs run in synchronism with each other, see FIG. 15. At this point in time, the film edges of the top film ply can be pulled in a controlled fashion to the desired position determining the frontal linear rim 5 of the bag to be manufactured. It is also possible now to insert bottom pleats 8 at the lateral edges. While thus far the manufacturing process has taken place continuously, and the tubular sheets have been transported further in continuous fashion, it is at this point in time that the cyclic or discontinuously to be performed operating steps follow for applying handle leaf reinforcements by welding, punching of the handle holes and hanging holes, perforating, corner seam welding, as well as transverse cutoff welding, and others. These steps are, respectively, conducted during standstill between the advancement of the sheets by respectively one bag width. The shopping bags 1, cut to size in paris during transverse cutoff welding, can then be stacked, for example on pin stackers or stacking plates and finished further. For example, the shopping bags in the stack 20 can be perforated, provided with hanging holes by punching, optionally handle holes can be provided by punching, and the interlocking features for the tear-off block can be produced.

Figure 2:
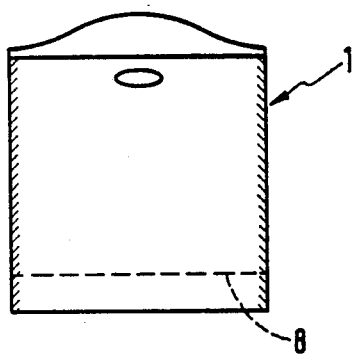

Bags according to FIGS. 1, 2 and 4, can be produced, for example, in continuous passage up to the transverse cutoff welding step, the punching of the hanging holes, of the handle holes, and interlocking taking place only in the stack.

If handle hole reinforcements ar desired, these can be applied, as shown in FIG. 15, prior to the transverse cutoff welding step and can be welded on, for example, see handle leaves 9, and thereafter can the handle holes 4 be punched through.

Figure 6:
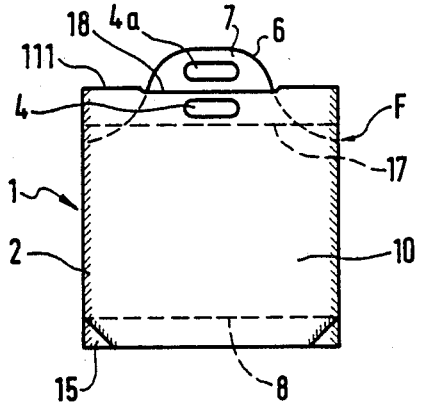
FIG. 6 shows a shopping bag with a pass-through slot in a side view.
Figure 7:
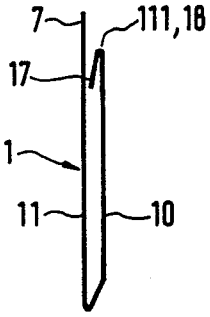
FIGS. 7 and 8 show two schematic cross-sections of the shopping bag according to FIG. 6 in the opened and sealed conditions.
Figure 8:
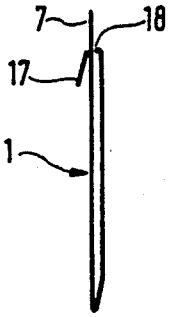
Figure 13:
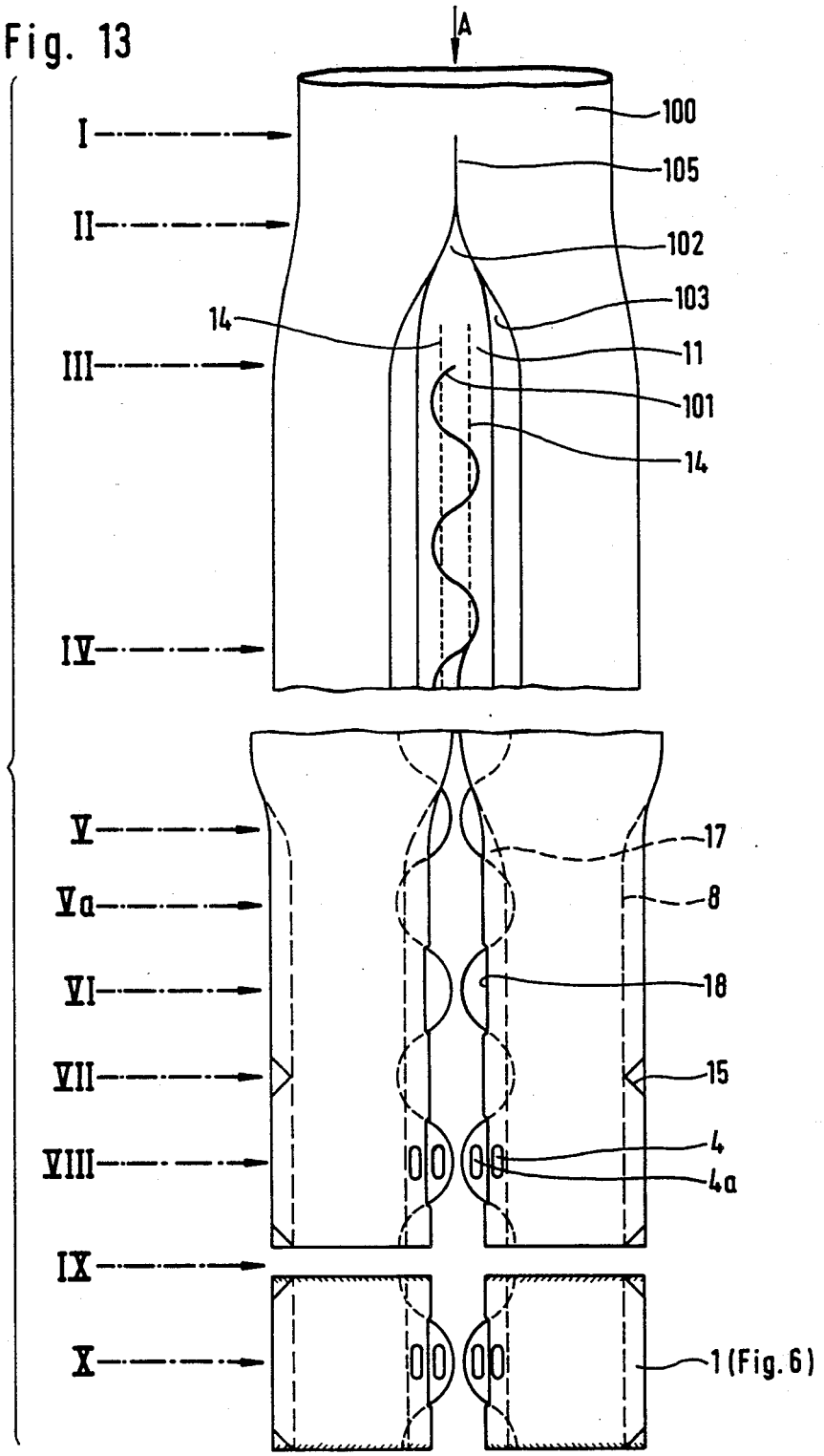
FIG. 13 shows schematic view to explain a process for manufacturing according to FIG. 6.

FIG. 13 shows an operating scheme with continuous and cyclic operating steps, using as example the manufacture of the bag according to FIG. 6. The tubular sheet 100 coming from an unwinding reel is severed in station I by a linear severing cut 105 in the top film ply constituting the front wall of the bag. Thereafter, the film rims 10 are spread apart in order to form the gap 102. The step of spreading apart can also take lace by folding over marginal strips from the outside or inside in station II. In subsequent station III, perforating can be effected in parallel to the longitudinal axis, see the rows of perforations 14, and subsequently the sinusoidal severing cut 101 can be executed in the bottom film ply 11, which cut forms the sinus rim 6 of the rear wall.

In station IV, the cut-open semitubular sheets are caused to diverge and to run offset with respect to each other so that the wave crests and wave troughs of the two semitubular sheets are further conducted while traveling at the same height. At station V, it is then possible to insert bottom pleats along the side edges and, if desired, marginal strips 17 at the film rims of the top film plies can be folded inwardly and pulled into position. Then follows compensating station Va which constitutes the intermediate storage means for the transition from continuous mode of operation to cyclic mode, i.e. advancement of the sheets by respectively one bag width. In subsequent station VI, it is possible, for example, to punch the slot 18 into the folded edge of the marginal strip of the top film plies. In a further station VII, the corner weld seams 15 can be produced in the bottom pleat sections. Prior thereto or thereafter, in station VIII, the handle hole 4 and optionally the handle hole 4a can be punched out. Then, in station IX, transverse cutoff welding and cutting to size of the bags 1 are performed.

In the illustrated scheme of FIG. 13, the rows of perforations 14 are not illustrated all the way through. If perforating has not already been doe in station III, then this step can also be carried out, after the transverse cutoff welding step, in stacking station X In the stacking station X, the bags are sacked up to the desired numbers, perforating can be executed within the stack, hanging holes can be punched, and the interlocking of the flaps 7 above the perforation can be performed.

For all those cases wherein a sinus flap 7 exhibiting a very large amplitude is desired, the procedure can be followed as indicated schematically by the steps of FIG. 16. After producing the sinusoidal severing cut 101 in the lower film ply of the tubular sheet 100, the semitubular sheets are pulled apart and guided in parallel. Then, triangular cutouts 6a are removed by punching in the zone of the wave troughs, if at all possible in a tangential extension of the wave crests In this way, the lateral rim of the sinus flap, i.e. the corners E and, respectively, F is or are disposed downwardly with respect to the flap. Tis structure of shopping bags with a sinusoidal rim having a very high amplitude is, of course, also applicable in case of sinusoidal bags wherein both walls are fashioned identically with a sinusoidal load-bearing rim.

What is claimed is:

1. A shopping bag of thermoplastic synthetic film comprising a front wall, a rear wall, a bag opening, handle holes in the front and rear walls near the bag opening, a closed bottom portion, and lateral weld seams, at the bag opening, the front wall terminating with a straight rim and the rear wall projecting beyond the front wall with an approximately sinusoidal rim whereby a protruding flap is formed, and the sinusoidal rim of the rear wall terminates at a height different from the straight rim of the front wall in the lateral seams.

2. A shopping bag according to claim 1, wherein the flap is provided with a roll of perforations so that the flap can be torn off and with at least one hanging hole in a portion of the flap that can be torn off.

3. A shopping bag according to claim 1, wherein the sinusoidal rim of the rear wall terminates above the straight rim of the front wall in the lateral seams.

4. A shopping bag according to claim 1, further comprising a handle leaf to reinforce a handle hole in at least one of the front and rear walls, said handle leaf being formed of thermoplastic synthetic resin film and being bonded to said bag.

5. A shopping bag according to claim 1, wherein the closed bottom portion is a bottom pleat.

6. A shopping bag according to claim 1, wherein the closed bottom portion is a folded portion of a synthetic resin film forming the front and rear walls.

7. A shopping bag according to claim 1, wherein the handle holes are provided below the straight rim of the front wall.

8. A shopping bag according to claim 1, wherein the handle holes are provided below the bag opening.

9. A plurality of shopping bags according to claim 1, further comprising means for interlocking projecting flaps of the plurality of bags together to form a stack of said plurality of bags; each of the projecting flaps being provided with means for facilitating tearing off of a bag from said stack.

10. A shopping bag of thermoplastic synthetic film comprising a front wall, a rear wall, a bag opening, handle holes in the front and rear walls near the bag opening, a closed bottom portion, and lateral weld seams, at the bag opening, the front wall terminating with a straight rim and the rear wall projecting beyond the front wall with an approximately sinusoidal rim whereby a protruding flap is formed, and the sinusoidal rim of the rear wall terminates at a height different from the straight rim of the front wall in the lateral seams and at the bag opening, a marginal strip of the front wall is folded inwardly over the entire bag width and is welded in place along the lateral weld seams, wherein the sinusoidal rim terminates below the folded-over marginal strip in the lateral seams, and a slot having a length sufficient for passing the flap therethrough is provided at a folded-over edge of the marginal strip.

11. A shopping bag according to claim 10, wherein handle holes are arranged in a zone defined of the folded-over marginal strip.

12. A shopping bag according to claim 10, wherein another folded-over marginal strip is formed at the lateral rims, starting from the lateral weld seams at the sinusoidal rim of the rear wall approximately in a sinusoidal shape by means of a cutoff weld seam with separation of corner sections.

13. A shopping bag according to claim 10, characterized in that a handle hole is formed in the flap.

14. A process for the paired production of shopping bags from thermoplastic synthetic resin sheeting, each of said bags comprising a front wall with a straight rim, a rear wall projecting beyond the front wall having an approximately sinusoidal rim forming a protruding flap, a closed bottom portion, a bag opening and lateral weld seams joining the front and rear walls, wherein a tubular film sheet providing top and bottom film plies is transported in a longitudinal direction, the top film ply of the tubular film sheet is cut open in the center by a straight cut and a gap is produced by pulling the severed film portions of the top film ply apart, the width of the gap being larger than an amplitude height of a sinus cut to be subsequently made in the bottom film ply covered by the gap, which film ply constitutes a rear wall of the pair of bags to be produced; then the bottom film ply is cut open in a sinusoidal shape to produce the sinus cut and to form a flap in a rear wall of each of the pair of bags to be produced; the severed semitubular film sheets are offset mutually by half a wavelength; thereafter cyclically handle holes are punched segment by segment through both top and bottom film plies of each bag to be produced; and the bags are cut to size and produced by cutoff welding transversely to the longitudinal direction.

15. A process according to claim 14, wherein the bottom film ply is provided with at least with one row of perforations in the longitudinal axis or in parallel to the longitudinal axis within the zone defined by the amplitude height of the sinusoidal severing cut prior to production of the sinus cut.

16. A process according to claim 15, wherein at least one hanging hole is punched into the separable areas, marked by the row of perforations of wave crests constituting the flaps.

17. A process according to claim 14, wherein an inward fold is produced along straight cutting edges at a time different than the sinusoidal cutting apart of the bottom film ply and positioned on the bottom film ply so that a wave trough still extends outside of the folded-over marginal strip; then the handle holes are punched centrally below the wave crest into the folded-over film zone; and slots are punched along the folded-over edge of the marginal strip in the region of the projecting wave crest.

18. A process according to claim 14, wherein severed bags are collected into stacks and, within the stack, in the zone of the projecting wave crests forming the flaps, the bags are provided with holes and interlocked.

19. A process according to claim 14, wherein approximately triangular cutouts are punched out in the zone of the wave troughs of the sinusoidal rim.

20. A shopping bag of thermoplastic synthetic film comprising a front wall, a rear wall, a bag opening, handle holes in the front and rear walls near the bag opening, a closed bottom portion, and lateral weld seams, at the bag opening, the front wall terminating with a straight rim and the rear wall projecting beyond the front wall with an approximately sinusoidal rim whereby a protruding flap is formed, and the sinusoidal rim of the rear wall terminates below the straight rim of the front wall in the lateral seams.

21. A shopping bag of thermoplastic synthetic resin film comprising a front wall, a rear wall, a bag opening, handle holes in the front and rear walls near the bag opening, a closed bottom portion and lateral weld seams, the front wall terminating at the bag opening with a straight rim and the rear wall projecting beyond a portion of the front wall with an approximately sinusoidal rim to provide a projecting flap and the sinusoidal rim of the rear wall terminating below the straight rim of the front wall in the lateral seams, and at the bag opening, a marginal strip of the front wall being folded inwardly over the entire bag width and being welded in place along the lateral weld seams so that the sinusoidal rim terminates below the folded-over marginal strip in the lateral seams and a slot having a length sufficient for passing a portion of the flap therethrough is formed at a folded-over edge of the marginal strip.

22. A shopping bag according to claim 21, wherein the handle holes are located in a zone defined by the folded-over marginal strip.

23. A process for the paired production of shopping bags from a thermoplastic synthetic resin sheeting, each of said bags comprising a front wall with a straight rim, a rear wall projecting beyond the front wall having an approximately sinusoidal rim forming a protruding flap, a closed bottom portion, a bag opening, and lateral weld seams joining the front and rear walls, wherein a flat film is folded on both sides with a central gap remaining between film edges to provide top and the bottom film plies and folded flat film is transported in a longitudinal direction, the width of the gap being larger than an amplitude height of the a sinus cut to be subsequently made in the bottom film ply and covered by the gap, which bottom film ply constitutes a rear wall of the pair of bags to be produced; then the bottom film ply is cut open in a sinusoidal shape to produce the sinus cut and to form a flap in a rear wall of each of the pair of bags to be produced; the severed semitubular film sheets are offset mutually by half a wavelength; thereafter cyclically handle holes are punched segment by segment through both top and bottom film plies of each bag to be produced; and the bags are cut to size and produced by cutoff welding transversely to the longitudinally direction.

* * * * *